US006713703B1

(12) United States Patent
Roza

(10) Patent No.: US 6,713,703 B1
(45) Date of Patent: Mar. 30, 2004

(54) DOOR OPENING CIRCUIT

(75) Inventor: Ivan Roza, Olten (CH)

(73) Assignee: EAO AG (CH)

( * ) Notice: Subject to any disclaimer, the term of this patent is extended or adjusted under 35 U.S.C. 154(b) by 0 days.

(21) Appl. No.: 10/169,784

(22) PCT Filed: Jan. 5, 2000

(86) PCT No.: PCT/CH00/00008

§ 371 (c)(1),
(2), (4) Date: Oct. 24, 2002

(87) PCT Pub. No.: WO01/50486

PCT Pub. Date: Jul. 12, 2001

(51) Int. Cl.[7] ..... H01H 13/00
(52) U.S. Cl. ..... 200/520; 200/518
(58) Field of Search ..... 200/504, 518, 200/520, 526, 528, 529, 533, 534, 298, 329, 330, 331, 334, 341, 552

(56) References Cited

U.S. PATENT DOCUMENTS 1,901,385 A * 3/1933 Warner et al. ..... 200/518
2,910,564 A * 10/1959 McBroom ..... 200/518
3,274,367 A * 9/1966 Clark ..... 200/518
6,345,464 B1 * 2/2002 Kim et al. ..... 200/518

FOREIGN PATENT DOCUMENTS

EP 0 749 136 A2 12/1996 ..... H01H/3/12

* cited by examiner

*Primary Examiner*—Michael Friedhofer
(74) *Attorney, Agent, or Firm*—Webb Ziesenheim Logsdon Orkin & Hanson, P.C.

(57) ABSTRACT

A door opening circuit comprises pipe-shaped housing and a button which can be moved axially in a housing in order to actuate a circuit component connected to the housing. The button is held in a rest position by a force and can be pushed in a direction opposing said force. Perpendicular to the push path of the bottom and pivotable about a pivot mount. A lever is provided perpendicular to the push path of the button and pivotable about a pivot mount. The lever acts upon a circuit component from a position at a distance to the pivotal mount, whereby the button impinges upon the lever between the pivotable mount and the aforementioned position. Another button is located concentrically to the first button on the reverse side of the housing. The pivotal mount is provided with a lever element. The lever can be moved in the direction of the housing longitudinal axis towards the first button. The other button impinges on the lever element and is held by a force in a rest position and can also be pressed in against the action of said force.

20 Claims, 4 Drawing Sheets

DOOR OPENING CIRCUIT

BACKGROUND OF THE INVENTION

1. Field of the Invention

This invention relates to a door opener switch with a tubular housing and a button that can move axially in the housing to actuate a switching mechanism that is connected with the housing, whereby the button can be held in its idle position by a restoring force and can be pushed in against the action of said return force, with a lever that is oriented transversely in the path of movement of the button and can be pivoted by the button around a pivot bearing, which lever acts with a location that is at some distance from the pivot bearing on the switching mechanism, whereby the button contacts the lever between the pivot bearing and the above mentioned location.

2. Brief Description of the Related Art

Door opener switches require a push button that has a large surface area with a short actuator travel and a flat construction. To achieve this combination, switches of the prior art are equipped with electronic circuit elements, although such elements are sensitive to voltage surges. Voltage surges of this type are common, especially in public transit systems such as railroads, streetcars etc. and can lead to damage to the switches or to disruptions in the operation of the door.

To correct this undesirable situation, this same applicant's EP 0 743 136 describes a door opener switch that combines the advantages of an electronic switch that has a short actuator travel with the advantages of a mechanical switch, in particular the rugged construction of the latter. This door opener switch works satisfactorily.

The door opener switches of the prior art described above generally have a collar, the front or back side of which forms a contact surface, and which are mounted in contact with the side surface of a streetcar or similar vehicle. In the prior art, two door opener switches, one inside and one outside, are currently required to operate a door.

SUMMARY OF THE INVENTION

On the basis of the prior art described above, the object of the invention is a door opener switch of the type described above, with which, in the form of a single switch, a door, for example the door of a public transit vehicle, can be actuated both from inside and from outside.

The invention teaches that on the back side of the housing there is an additional button which is oriented concentric to the first button, that the pivot bearing is provided in a lever element which can be displaced in the direction of the longitudinal axis of the housing toward the first button, that the additional button contacts the lever element and that the additional button is held in its idle position by the restoring force and can be pushed in against the action of said restoring force. Therefore the invention also teaches a dense construction that creates a simple and also streamlined double door switch regardless of the actual thickness of the glass.

Additional advantageous embodiments of the invention are disclosed.

BRIEF DESCRIPTION OF THE DRAWINGS

The invention is described in greater detail below on the basis of the accompanying schematic drawings, in which.

DETAILED DESCRIPTION OF THE PREFERRED EMBODIMENTS

Figure 1:
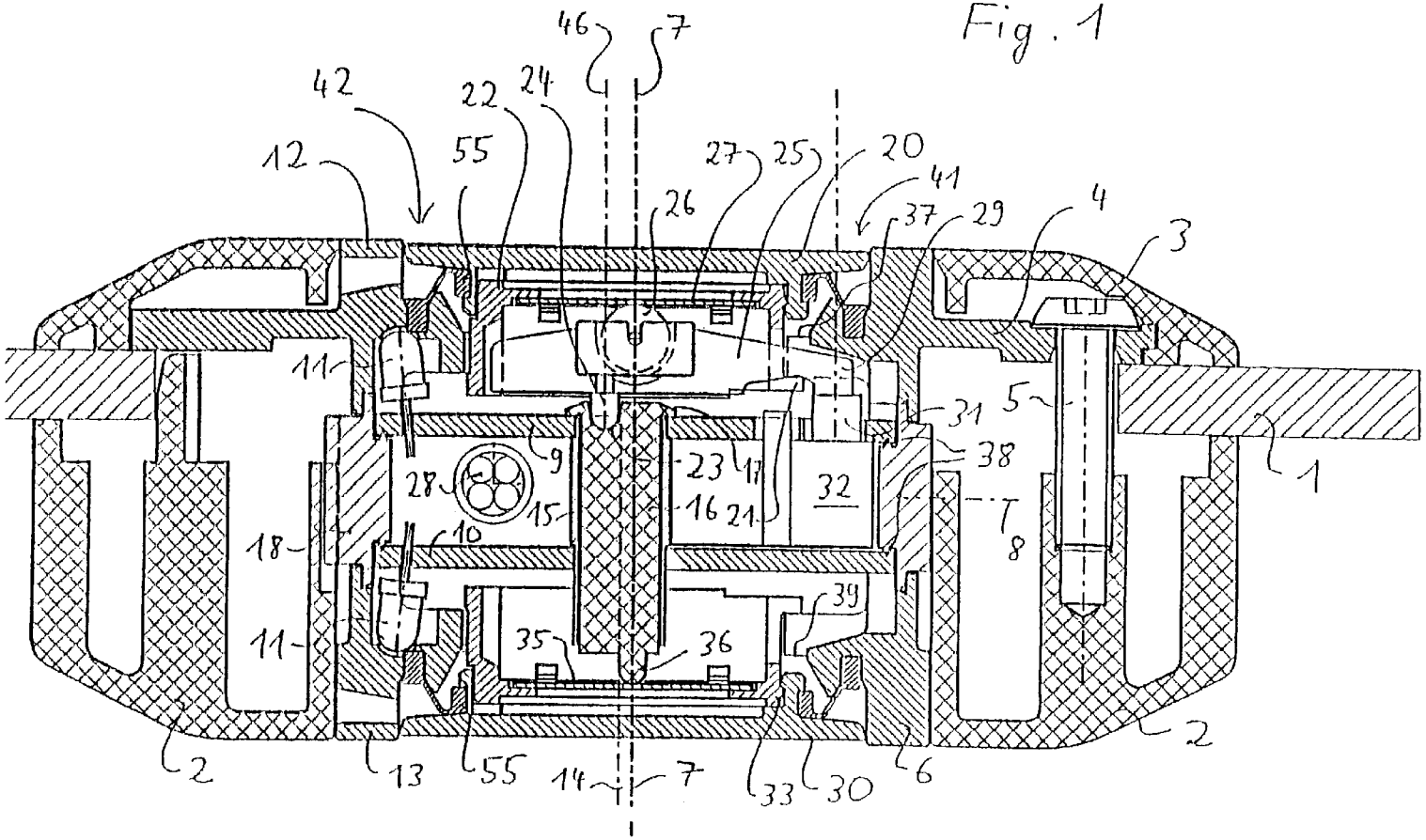
FIG. 1 is a longitudinal section through a door opener switch according to the present invention.
Figure 2:
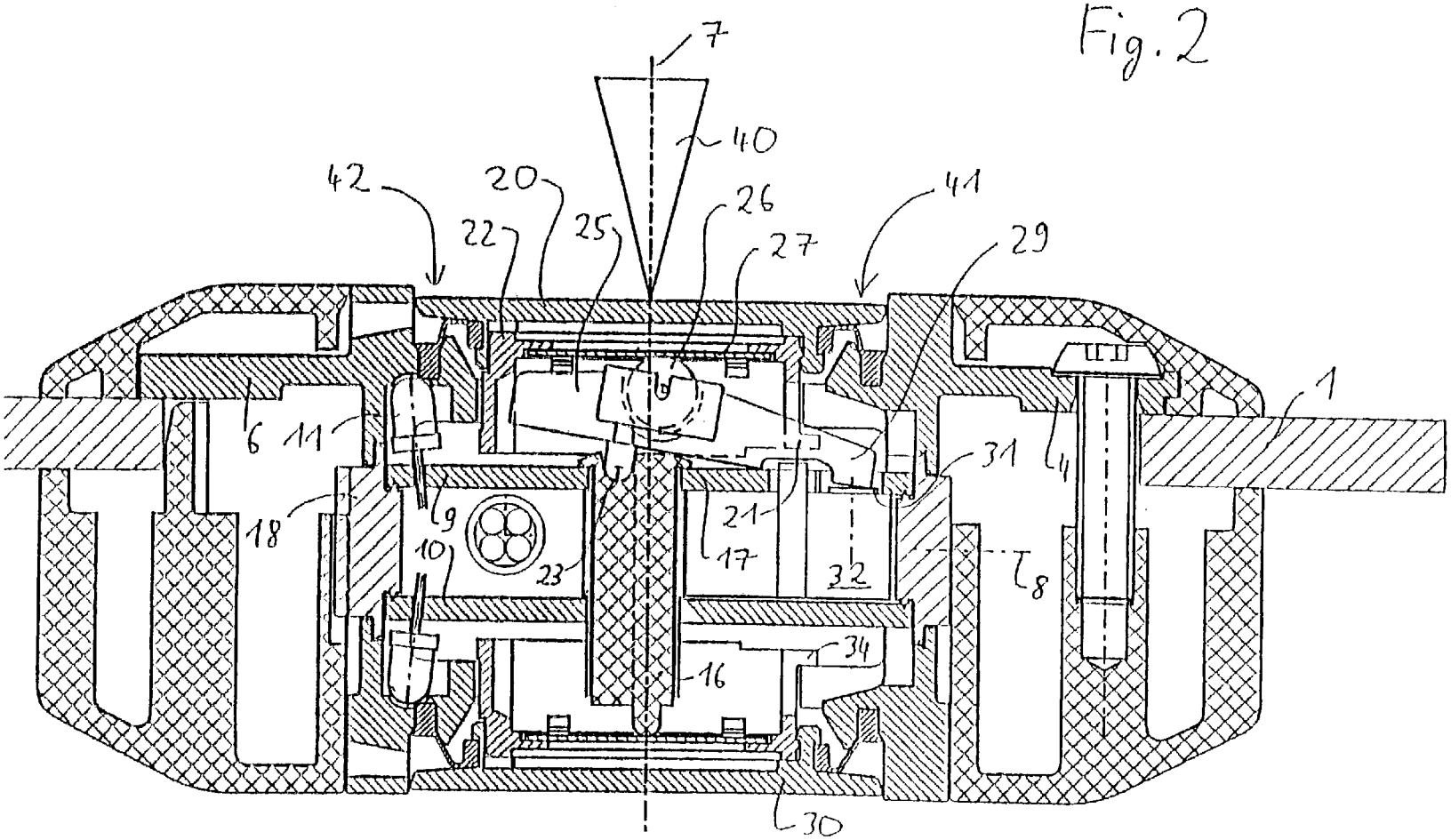
FIG. 2 illustrates the function of the door opener switch illustrated in FIG. 1 when the switch is actuated from the front side.

FIG. 1 shows a longitudinal section through a door opener switch according to the present invention. The switch has a multiple-part, tubular housing which is installed in a mounting surface 1. The mounting surface 1 can be, among other things, a glass door on a public transit vehicle. The housing consist of, among other things, a rear, hollow, cylindrical jacket 2 and a front cover hood 3. The cover hood 3 covers, among other things, the jacket support 4 which has at least one opening through which a screw 5 is screwed into a corresponding thread of the rear jacket 2. In this manner, the door opener switch is fixed in position in the mounting plate 1. Inserted into the rear jacket 2 is a housing ring 6 which is realized in its internal area so that it is similar to the housing jacket support 4 and forms a symmetrical interior with regard to the housing axis 7 and the switch plane 8 that is perpendicular to said housing axis 7.

Two circuit boards 9 and 10 are oriented parallel to each other and symmetrically with reference to said plane 8. On these circuit boards 9 and 10 there are, among other things, diodes 11 in a diode array that preferably illuminate the ends 12 and 13 of the door opener switch and improve the visibility of the switch for a user or indicate to the user the operating status of the switch. For this purpose, the housing elements 4 and 6 naturally must be made of a translucent material. The circuits boards 9 and 10 have a through-boring placed around the axis 14, whereby the axis 14 runs at a short distance of one millimeter, for example, parallel to the longitudinal axis 7 of the housing. A sleeve 15 is inserted into this opening through the circuit boards 9 and 10, in which sleeve a lever element 16 is mounted. This lever element 16 is movable in the direction of its axis of symmetry 14. The lever element has, on its front side, a stop collar 17 which forms a stop for the movement of the first lever element 16 into the rear portion of the switch.

Instead of a diode array, it is also possible to use optical fibers that, starting from a luminous element, can be routed to different points of the switch underneath a transparent area of the switch. The light that escapes from the ends of the optical fibers then indicates to the user the operating status of the switch. It is thereby possible to bundle different optical fibers at the respective light exit points, that are each fed light from a different colored light source, such as a light-emitting diode, for example.

The circuit boards 9 and 10 are inserted in a ring-shaped circuit board carrier 18 which is supported between the housing elements 4 and 6 and against them. They thereby lie on a plurality of small pyramids 38 and when the housing elements 4 and 6 are assembled, they are pressed against them correspondingly. The result is an outward facing surface of the circuit boards 9 and 10 that has a defined axial position. These above mentioned connections are then ultrasonically welded to form a tight, one-piece switch unit. In the sleeve there is an opening through which the connecting cables 28 can be led out sideways.

The switch function is initiated by means of a front pushbutton 20 and a back pushbutton 30, both of which preferably have a rather large diameter. The pushbutton 20 and 30 are connected with the elements 4 and 6 by means of a sealing elastic sealing bellows, which is illustrated in greater detail in FIG. 4. The pushbuttons 20 and 30 can in particular move along their axis of symmetry 7 toward the center of the housing of the door opener switch. In the idle position of the switch illustrated in FIG. 1, the pushbutton 20, which is connected with the pushbutton carrier 22, is in a stop by means of the collar 21. The same arrangement is used for a push button 30, which is secured to prevent it from falling out by means of a corresponding stop 34 against the element 6.

The above mentioned lever element 16 has a pivot bearing 23 that can be offset laterally from the axis 14 with respect to the axis 7, and has among other things a ball socket in which a projection 24 of a lever 25 is mounted. As shown by the additional axis 46 which is shown parallel to the housing axis 7, the pivot bearing 23 is located at some lateral distance away from the longitudinal axis 7 of the housing, which distance is greater than the distance between the axis of symmetry 14 of the lever element 16 and the longitudinal axis 7 of the housing. This distance can be 2.2 millimeters, for example. The lever 25 has a shaft that runs transversely in which a roller 26 is mounted and impacts a leaf spring 27. The lever 25 has a lever end 29 which is at a distance from the housing longitudinal axis 7 that is, for example, eight to ten times greater than the distance from the additional longitudinal axis 46. The lever end 29 is in contact with a spring-loaded actuator cam 31 which is associated with a mechanical switching mechanism 32.

The operation of the electrical door opener when the switch is actuated from the front side is illustrated in FIG. 1. The same features are identified with the same reference numbers in all the figures. For reasons of simplicity, however, not all the elements are shown in all the figures. The arrow 40 indicates the application of a force to the front push button 20. When actuated by said force, the push button carrier 22 is displaced toward the longitudinal axis 7 of the housing into the interior of the switch. The above mentioned contact 21 is thereby released. With the movement of the push button carrier 22, the leaf spring 27 of the push button carrier 22 is likewise displaced, whereby the roller 26 is in contact with the leaf spring. As a result of the lateral offset of the pivot bearing 23, the roller 26 runs along the leaf spring 27 and moves away from the longitudinal axis 7 of the housing. This happens because the lever element 16, on account of the contact 17, can move no farther toward the longitudinal axis 7 of the housing. As a result of the lever arm thereby formed between the roller 26 and the pivot bearing 23, the lever 25 tilts and the lever end 29 actuates the actuator cam 31 inside the mechanical switching mechanism 32.

This function occurs regardless of whether the force is applied centrally to the longitudinal axis 7 of the housing, as illustrated by the arrow 40. When the force is applied in the area 41, FIG. 1 shows that the roller is thereby moved even somewhat more quickly toward the longitudinal axis 7 of the housing. The ring-shaped stop 37, or when the push button 30 is pressed, the ring-shaped stop 39, on the opposite side between the front push button carrier 22 and the housing element 4, forms the fulcrum of such a lateral application of pressure. The same is true if the force is applied on the opposite peripheral area 42, because the movement of the push button 20 in any case leads to an axial movement of the roller 26 which results in a tipping of the lever 25. Therefore a central application of force is not necessary; any force applied to the push button 20 that leads to a tipping produces the desired switching result.

Figure 3:
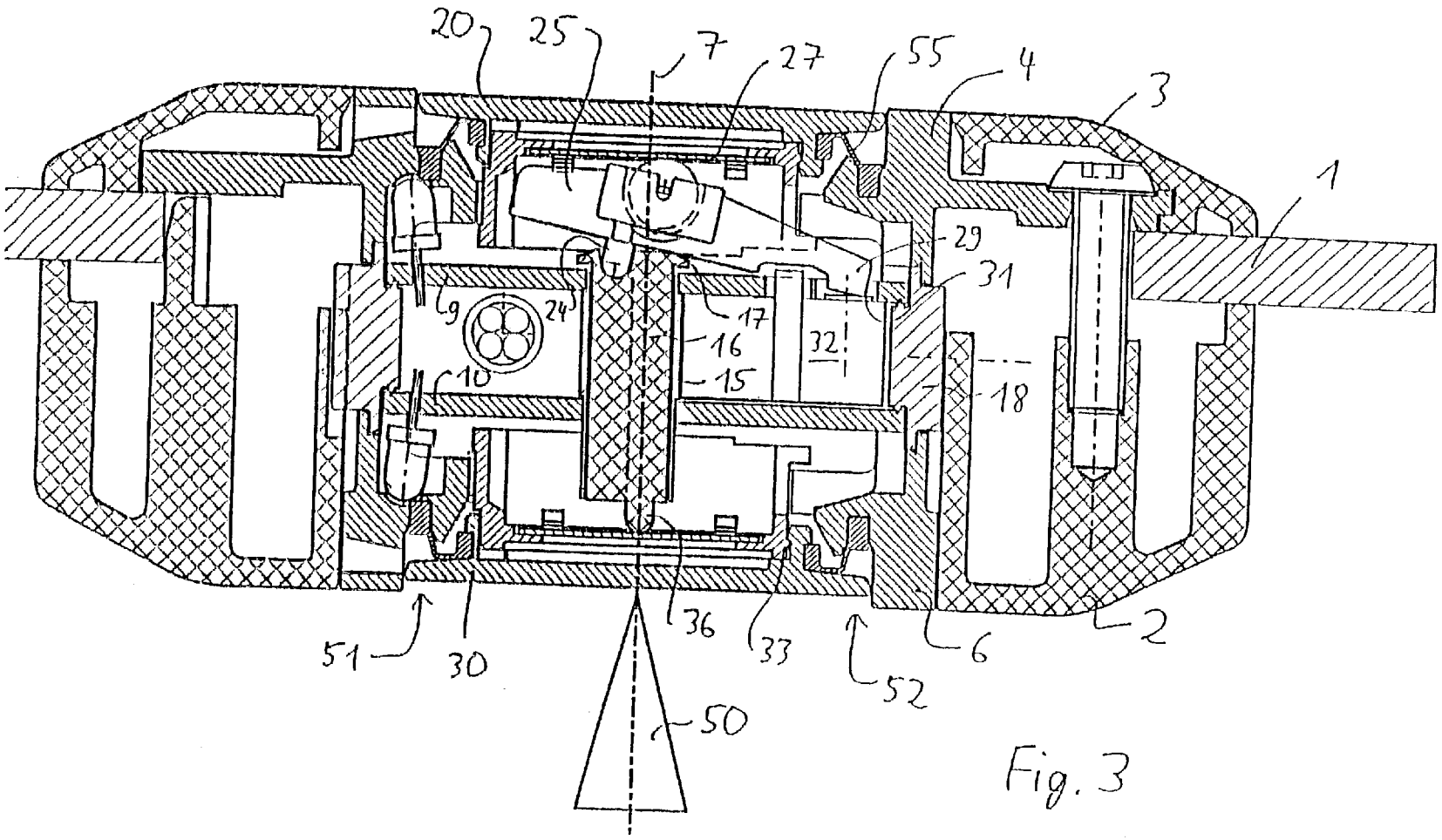
FIG. 3 illustrates the function of the door opener switch illustrated in FIG. 1 when the switch is actuated from the back side.

With reference to FIG. 3, the actuation of the door opener switch from the back side is described below, and is symbolized by the application of force corresponding to the arrow 50. The rear push button 30 is thereby displaced along the longitudinal axis 7 of the housing into the interior of the door opener switch. This movement results in a detachment of the rear push button carrier 33 with its collar 34 from the corresponding stop of the element 6. The rear push button carrier 33, analogous to the front push button carrier 22, has a leap spring 35, whereby in this case an additional actuator cam 36 is in contact, which is a projection of the first lever element 16. As a result of the axial displacement of the push button 30, the leaf spring 35 and thus, via the additional actuator cam 36, the first lever element 16 is displaced in its sleeve 15 along the axis 46 and thus parallel to the axis 7. This displacement leads to a lifting of the collar 17 of the lever element 16 from the circuit board 9. Because the front push button 20 is in the stop by means of the collar 21 of the front push button carrier 22, the leaf spring cannot move in the axial direction 7. In this case, too, the roller 26 is therefore also in a restricted guidance, which as a result of the axial upward movement of the pivot bearing 23 leads to a tipping movement of the actuator cam 24 together with the roller 26, so that the lever 25 in this case is also tipped and with its lever end 29 actuates the actuator cam 31 of the mechanical switching mechanism 32.

The same observation applies in the event of the application of pressure to the rear push button 30 at the sites 51 and 52, or in general on the circular edge of the push button. In all cases, the facing part of the collar 34 of the rear push button carrier 33 is in contact, so that a tipping of the rear push button 30 still leads to an axial movement of the first lever element 16, although with a somewhat shorter stroke. However, that is actually an advantage in the illustrated construction, because even extremely short actuator travels result in a reliable actuation of the mechanical switch element 32 on account of the translation ratio of the lever 25.

Figure 4:
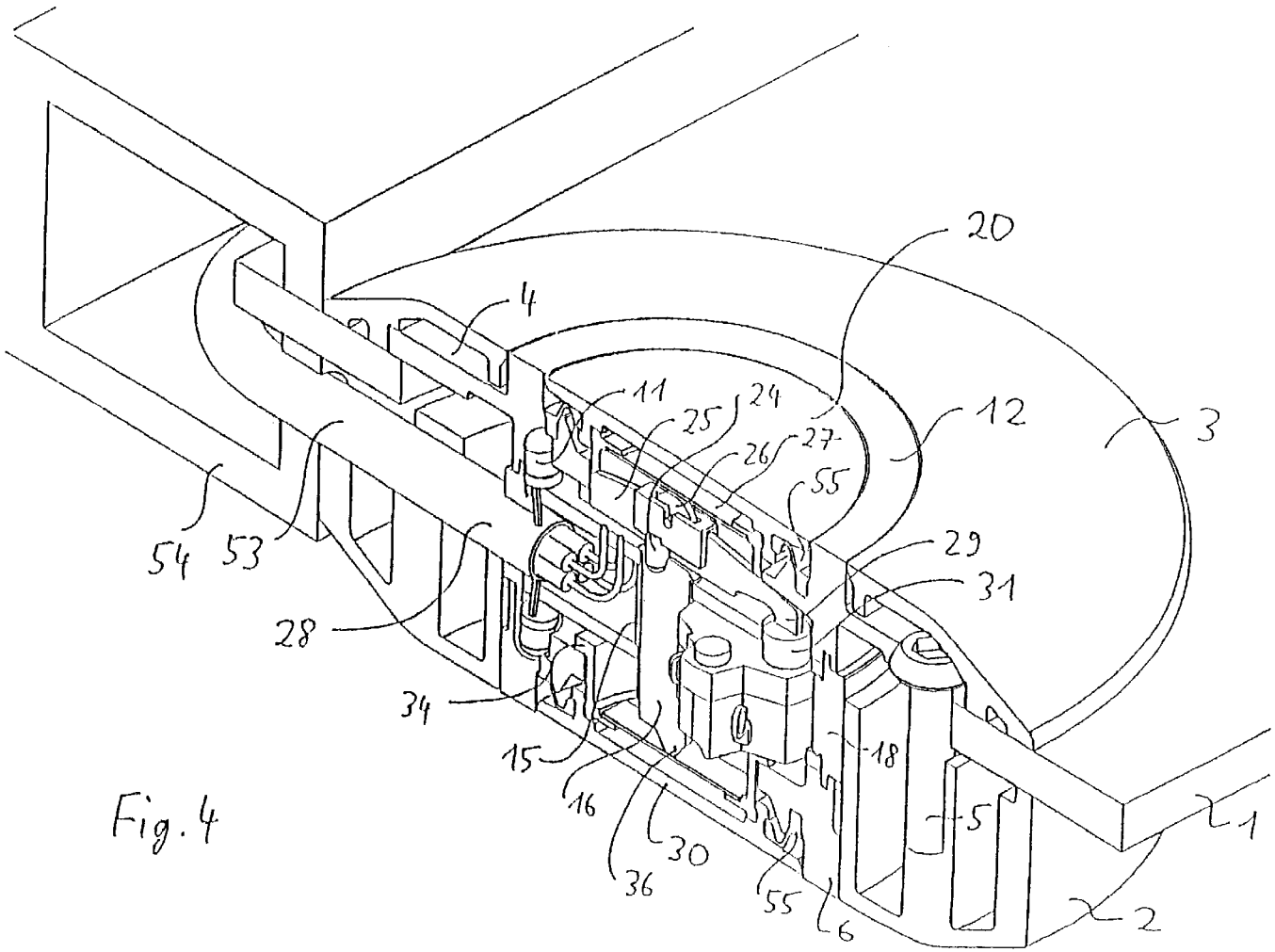
FIG. 4 is a view in perspective of the door opener switch illustrated in FIG. 1 installed in a glass door.

Finally, FIG. 4 shows a door opener switch installed in a glass door, in which case the mounting plate 1 can be made of glass, for example. Reference number 53 designates the electrical feed lines that run in a frame 54 of the glass pane 1 to a control circuit. In the view in perspective, the mechanical switching element 32 which is switched by means of the actuator cam 31 is shown particularly clearly. The lever 25 is a rectangular element in which the roller 26 is mounted in a slot that runs transversely. FIG. 4 shows especially clearly the collar 34 of the rear push button carrier 33 as well as the front and rear sealing bellows 55.

The restoring force, however, is generated essentially exclusively by the spring-loaded actuator cam 31 which, after the end of the application of pressure to the front or rear push button 20 or 30, returns said push button 20 or 30 to its normal position by a return movement of the lever 25. This sequence of events occurs because on one hand the lever 25 with its cam 24 pushes the lever element 16 with its collar 17 into contact with the circuit board 9, and on the other hand moves the roller 26 into its idle position, which brings the front push button 20 into contact with the collar 21.

As shown in FIG. 4, the rear jacket 2 forms the rear rosette which covers the switch and can be designed aesthetically and holds the glass pane 1 between it and the element 4, whereby the front rosette 3 is engaged on this element. In contrast to the configuration illustrated in the accompanying figures, the door opener switch can naturally also be symmetrical with reference to the mounting plate 1. In general, however, the illustrated embodiment, in which the flat side with the push button 20 faces outward, improves operational safety and reliability, because it is more resistant to tampering and attempted vandalism.

What is claimed is:

1. A door opener switch with a tubular housing and a button that moves axially in the housing to actuate a switching mechanism that is connected with the housing, whereby the button is held in its idle position by a restoring force and can be pushed in against the action of said restoring force with a lever that is oriented transversely in the displacement path of the button and can be pivoted by the button around a pivot bearing, which lever acts with a point at some distance from the pivot bearing on the switching mechanism, whereby the button is in contact with the lever between the pivot bearing and the point, wherein, on the back side of the housing there is an additional button which is concentric to the first button, the pivot bearing is located in a lever element which can be moved in the direction of the longitudinal axis of the housing toward the first button, the additional button contacts the lever element and the additional button can be held in its idle position by the restoring force and can be pushed in against the action of said restoring force.

2. The door opener switch as claimed in claim 1, wherein the contact point of the lever with the first button and the contact point of the lever element with the additional button lie in the longitudinal axis of the housing, which is at some lateral distance from the pivot bearing.

3. The door opener switch as claimed in claim 2, wherein the buttons can be tipped around the contact points.

4. The door opener switch as claimed in claim 1, wherein the pivot bearing is a universal joint.

5. The door opener switch as claimed in claim 3, wherein the restoring force is applied essentially by the restoring spring that is present in the switching mechanism and acts on the actuator cam.

6. The door opener switch as claimed in claim 5, wherein the buttons have a push button connected with a push button carrier, which push button is guided in the housing with radial clearance, and in the idle position of the buttons, the respective push button carriers are in contact with stops that are distributed radially symmetrically with reference to the longitudinal axis of the housing on contact surfaces that are stationary with respect to the housing, and are held against the latter stops by the restoring force.

7. The door opener switch as claimed in claim 3, wherein, in the housing, transverse to the path of displacement of the buttons, fastened without play there is a lever element that has the pivot bearing and the pair of circuit boards that comprise the switching mechanism.

8. The door opener switch as claimed in claim 2, wherein the pivot bearing is a universal joint.

9. The door opener switch as claimed in claim 2, wherein the restoring force is applied essentially by the restoring spring that is present in the switching mechanism and acts on the actuator cam.

10. The door opener switch as claimed in claim 9, wherein the buttons have a push button connected with a push button carrier, which push button is guided in the housing with radial clearance, and in the idle position of the buttons, the respective push button carriers are in contact with stops that are distributed radially symmetrically with reference to the longitudinal axis of the housing on contact surfaces that are stationary with respect to the housing, and are held against the latter stops by the restoring force.

11. The door opener switch as claimed in claim 2, wherein, in the housing, transverse to the path of displacement of the buttons, fastened without play there is a lever element that has the pivot bearing and the pair of circuit boards that comprise the switching mechanism.

12. The door opener switch as claimed in claim 1, wherein the pivot bearing is a universal joint.

13. The door opener switch as claimed in claim 12, wherein the restoring force is applied essentially by the restoring spring that is present in the switching mechanism and acts on the actuator cam.

14. The door opener switch as claimed in claim 13, wherein the buttons have a push button connected with a push button carrier, which push button is guided in the housing with radial clearance, and in the idle position of the buttons, the respective push button carriers are in contact with stops that are distributed radially symmetrically with reference to the longitudinal axis of the housing on contact surfaces that are stationary with respect to the housing, and are held against the latter stops by the restoring force.

15. The door opener switch as claimed in claim 12, wherein, in the housing, transverse to the path of displacement of the buttons, fastened without play there is a lever element that has the pivot bearing and the pair of circuit boards that comprise the switching mechanism.

16. The door opener switch as claimed in claim 1, wherein the restoring force is applied essentially by the restoring spring that is present in the switching mechanism and acts on the actuator cam.

17. The door opener switch as claimed in claim 16, wherein the buttons have a push button connected with a push button carrier, which push button is guided in the housing with radial clearance, and in the idle position of the buttons, the respective push button carriers are in contact with stops that are distributed radially symmetrically with reference to the longitudinal axis of the housing on contact surfaces that are stationary with respect to the housing, and are held against the latter stops by the restoring force.

18. The door opener switch as claimed in claim 16, wherein, in the housing, transverse to the path of displacement of the buttons, fastened without play there is a lever element that has the pivot bearing and the pair of circuit boards that comprise the switching mechanism.

19. The door opener switch as claimed in claim 1, wherein, in the housing, transverse to the path of displacement of the buttons, fastened without play there is a lever element that has the pivot bearing and the pair of circuit boards that comprise the switching mechanism.

20. The door opener switch as claimed in claim 18, wherein the housing that surrounds the push button is made of translucent material, the circuit boards are equipped in the vicinity of the housing wall with light-emitting diodes that face the respective housing side, and the housing wall is provided with recesses to hold the light-emitting diodes.

* * * * *

UNITED STATES PATENT AND TRADEMARK OFFICE

CERTIFICATE OF CORRECTION

PATENT NO. : 6,713,703 B1
DATED : March 30, 2004
INVENTOR(S) : Ivan Roza

It is certified that error appears in the above-identified patent and that said Letters Patent is hereby corrected as shown below:

Column 5,
Lines 11 and 24, “held in its” should read -- held in an --.
Line 13, “in the displacement” should read -- in a displacement --.
Line 18, “wherein, on the” should read -- wherein, on a --.
Lines 37 and 57, “by the restoring” should read -- by a restoring --.
Lines 39 and 62, “the actuator cam” should read -- an actuator cam --.
Line 48, “the latter stops” should read -- the stops --.
Line 51, “there is a lever” should read -- there is the lever --.
Line 52, “and the pair” should read -- and a pair --.
Line 62, “which push button” should read -- the push button --.

Column 6,
Lines 6 and 26, “the latter stops” should read -- the stops --.
Lines 9, 29, 47 and 52, “there is a lever” should read -- there is the lever --.
Lines 10, 30, 48 and 53, “and the pair” should read -- and a pair --.
Line 12, “as claimed in claim 1” should read -- as claimed in claim 3 --.
Lines 14 and 27, “as claimed in claim 12” should read -- as claimed in claim 4 --.
Line 15, “essentially by the” should read -- essentially by a --.
Line 17, “the actuator cam” should read -- an actuator cam --.
Lines 20 and 38, “which push button” should read -- the push button --.
Line 33, “by the restoring” should read -- by a restoring --.
Line 55, “as claimed in claim 18” should read -- as claimed in claim 19 --.
Line 57, “equipped in the” should read -- equipped in a --.
Line 59, “face the respective” should read -- face a respective --.

Signed and Sealed this

Eleventh Day of October, 2005

JON W. DUDAS
*Director of the United States Patent and Trademark Office*